US005102131A

United States Patent [19]

Remington et al.

[11] Patent Number: 5,102,131

[45] Date of Patent: Apr. 7, 1992

[54] LUMINOUS GAME BALLS

[76] Inventors: Bruce Remington, 2168 Meadowood La., Eureka, Calif. 95501;

[21] Appl. No.: 556,942

[22] Filed: Jul. 24, 1990

[51] Int. Cl.[5] ..... A63B 43/06; A63B 41/00

[52] U.S. Cl. ..... 273/58 G; 446/438; 273/65 EE; 273/63 R

[58] Field of Search ..... 273/58 B, 58 BA, 58 G, 273/65 EE; 446/438, 439, 484, 485, 242

[56] References Cited

U.S. PATENT DOCUMENTS

| | | | |
|---|---|---|---|
| 2,020,484 | 11/1935 | Turner | 240/6.4 |
| 3,011,048 | 11/1961 | O'Brien | 240/6.4 |
| 3,229,976 | 1/1966 | Allen | 273/58 B |
| 3,610,916 | 10/1971 | Meehan | 240/6.4 R |
| 3,804,411 | 4/1974 | Hendry | 273/58 G |
| 4,002,893 | 1/1977 | Newcomb | 240/6.4 R |
| 4,015,111 | 3/1977 | Spector | 240/2.25 |
| 4,776,589 | 10/1988 | Yang | 273/58 G |

*Primary Examiner*—George J. Marlo

[57] ABSTRACT

Self-illuminated luminous game balls for nighttime play which may be either inflated or self-supporting and consist of various apparently ordinary looking balls with portable electric lighting assemblies or chemiluminescent lights, including fireworks inside them for exciting novel effects.

A shaft manufactured integrally within a toroidal form is disclosed which firmly holds an electric or other lighting assembly such that said lighting assembly may be removed in its entirety for servicing or replacement, through a flush, waterproof cover designed for such purpose.

A conveniently located On-Off switch is also located such that it may be actuated without deflating the ball, and its electrical connections to the batteries and bulbs are designed so that the center of gravity of said heavy batteries and other electronics are mounted near the center of gravity of said ball for optimum handling and closer simulation of a normal play ball.

The methods described are versatile enough to light up virtually any existing game ball or facsimile thereof. These balls have been well tested for feasibility and provide a very new, and interesting and exciting nighttime recreation.

1 Claim, 3 Drawing Sheets

LUMINOUS GAME BALLS

BACKGROUND OF THE INVENTION

The magical idea of playing with beautiful luminous game balls at night has intrigued and challenged inventive minds since at least 1929, and probably earlier. Many reasons for this are apparent such as the night time aesthetic appeal of a brightly colored translucent object like a full moon, the excitement of games in the dark, the irritation perhaps remembered from childhood of having to stop various ball games due to darkness, and the inability to see adequately or to find lost balls in the shadows. Also there is the desire to produce a fresh, new, different, pleasurable and exciting night game and product for the public's pleasure, and the inventor's satisfaction and profit.

Numerous playballs with various types of lights inside, a few of which were inflated, have been patented over the years; however, as eloquently stated in 1977 by Nelson Newcomb, undoubtedly one of the more serious illuminated playball inventors, "as far as we are aware none of the devices of the prior art have been commercially marketed because of expensive, complicated constructions and the inability of the lighting structures mounted within to withstand for long the rough handling and high acceleration and deceleration to which balls are subjected when they are thrown, caught, kicked, or bounced on the ground."

To our knowledge, except for a small chemical wiffle ball with a patent pending, nothing has changed much since then.

DESCRIPTION OF THE PRIOR ART

Various rigid, translucent, mostly non-inflatable type balls are shown in the prior art with electric or chemical lights and other complicated devices inside them which have only an indirect relation to this application. These patents would include: U.S. Pat. No. 1,826,221—Pearson; U.S. Pat. No. 2,020,484—Turners; U.S. Pat. No. 2,213,868—Lucian; U.S. Pat. No. 2,307,362—Dupler; U.S. Pat. No. 2,660,661—Dupler; U.S. Pat. No. 2,780,029—Anthony; U.S. Pat. No. 2,838,872—Beck; U.S. Pat. No. 2,849,819—Murphy et al.; U.S. Pat. No. 2,871,343—Whitney; U.S. Pat. No. 2,903,820—Bodell; U.S. Pat. No. 3,011,048—O'Brien; U.S. Pat. No. 3,058,261—Lakin; U.S. Pat. No. 3,229,976—Allen, Jr.; U.S. Pat. No. 3,304,651—Deyerl; U.S. Pat. Nos. 3,458,205; 3,521,886—unknown; U.S. Pat. 3,539,794—Rauhut et al.; U.S. Pat. No. 3,578,962—Gerber; U.S. Pat. No. 3,580,575—Speeth; U.S. Pat. No. 3,610,916—Meehan; U.S. Pat. No. 3,755,820—Petrusek; U.S. Pat. No. 3,786,246—Johnson et al.; U.S. Pat. No. 3,798,834—Samuel; U.S. Pat. No. 3,800,132—Postal; U.S. Pat. No. 3,804,411—Hendry; U.S. Pat. No. 3,875,602—Miron; U.S. Pat. No. 4,015,111—Spector; U.S. Pat. No. 4,002,893—Newcomb; U.S. Pat. No. 4,179,832—Lemelson; U.S. Pat. No. 4,282,680—Zamba; U.S. Pat. No. 4,292,999—Szclimann; U.S. Pat. No. 4,335,538—Greenberg; U.S. Pat. No. 4,479,649—unknown; U.S. Pat. No. 4,776,589—Yang; and German patent 1,172,585.

Some of these disclosures exhibited fine work and in a few cases were of help in the earlier designs of some of the more than fifteen (15) experimental balls that were designed, built and laboratory tested during the development of this invention.

The most interesting and important lighted inflatable ball known to the present inventor was patented by Chao-Ming Yang on Oct. 11, 1988, in U.S. Pat. No. 4,776,589. His work was admirable in certain respects and he may have come the closest so far to inventing a merchandizable illuminated ball.

The prior art presents some good ideas; however, upon closer analysis and then detailed scrutiny and actual experiments with real PVC balls with real batteries and real lights inside, many problems arose. In fact, as disclosed, his concept would appear to be unsuitable for commercial use for these reasons: 1) It is impossible to service his balls when they fail without cutting open the ball and ruining it, and it has been discovered by dozens of relevant experiments that when a ball is played with normally with reckless abandon as intended, bulbs usually do not last very many minutes before needing replacement, at which time his ball would revert to a heavy, expensive, nonlighted ball because you can't change his bulbs; 2) two batteries in the scale disclosed are too heavy for optimum play with most balls; 3) however, they would probably be necessary to drive his four proper intensity bulbs, which although looking good, are two or three more than optimum according to the experiments of the present inventor, because they would cause excessive battery drain and too short an illumination time; 4) an outwardly projecting inflation nozzle 13 in his patent, ruins proper, even and controlled bouncing, is unpleasant to catch and should be recessed; 5) his unnecessarily complicated central hollow compartment and accessories are expensive to properly manufacture, install and seal efficiently; 6) as his switch is buried deep inside the ball somewhere, and as his central compartment contracts around the batteries and switch after inflation, it would appear that the only way to turn the lights on and off is to deflate the ball which is more than very irritating to a user; 7) a good sharp kick of Yang's ball in any of four places adjacent to the bulbs is going to smash a light bulb badly with unpredictable consequences. Experiments show that the bulbs need to be more centrally located and better protected. This becomes of paramount importance if the ball loses any pressure at all and softens-up even a little, for any reason. Otherwise, some kind of indestructible light bulb must be discovered, developed and deployed; 8) as shown, his cap 31 and indeed his entire central compartment diameter is improperly large. The result being possible failure of his batteries to be held firmly by air pressure pushing in on his hollow compartment, unsightly wrinkling on the ball's surface at both ends of the hollow compartment 3 and also a lack of strength, resilience, and tension in the same areas under certain conditions; 9) further, his top closure 31 sticksout at least ¼" beyond flush making his lighted ball difficult to bounce evenly and otherwise awkward and unlike an ordinary ball in playing characteristics which is disadvantageous; finally, Yang uses an incredible amount of apparently needless wire, complicated and expensive electrical connections and plastic seals very likely to cause problems when subjected to hard kicks and other strong and highly unpredictable stresses. It has been found that copper wires and all artificial air seals have ways to break and fail after only a few minutes of normal play because of extreme vibrations, flexing and many other types of forces. Otherwise, Yang was on the right track.

The present invention has attempted to overcome all of the above objections while salvaging some of the ideas of Yang and others cited above.

OBJECTIVES AND ADVANTAGES

The object of this invention is to provide a practical, usable, cheap, and easily mass produced luminous looking new type of game ball which can be manufactured and then sold to the public. It will be bright, colorful and cheerful by day in the preferred embodiment and at night will resemble a miniature full moon if colored translucent white, the planet earth, when blue, a circus balloon in other colors or it may resemble some kind of conventional ball except that it will glow from within. Many experiments have demonstrated that this invention can provide a fresh, new, stimulating, exciting and pleasurable night game if properly designed and engineered.

The advantages and general characteristics of the present invention include the following nineteen (19) concepts, about half of which are novel, while the others have been revealed in the prior art.

1/ The illuminated luminous ball disclosed below with all its many variations will frequently be inflatable; however, many balls which are better non-inflatable exist as well. The lighting means for all the balls contained herein consist of battery operated electric light bulbs or other light emitters, chemi-luminescent devices or flame and spark emitting fireworks. Inflatable balls are advantageous wherever possible due to their versatility, good playing characteristics, thinner skins and economy due to less material used and the possibility of distributing them in deflated forms, hence taking up less cargo space and costing less to ship.

However, there are other balls whose characteristics or sports historically require, or by habit prefer, that they be rigid and self-supporting. Balls of this type include those for bowling, golf, tennis, baseball, wiffling, ping pong, croquet, lacrosse, squash, jai alai, and handball to name a few. Some of these kinds of balls have been tested and others not.

Any lighted translucent ball looks great, and the concept is particularly suitable for use with any inflated type ball which tend to handle the shock of racquets, bats, mallets and kicks fairly well. In a non-inflated ball it is important to determine for each kind of ball and set of forces on said ball, a suitable translucent shock absorbing and reducing material to use in the areas occupied by air in an inflated version of the present invention, such as some combination of air and a crumpled up translucent material such as PVC, vinyl, or cellophane, or solid latex rubber or solid translucent plastic plus lots of plasticizer. Other solid materials or water might also be used. An example of this kind of application would be a plasticized polyethylene, PVC, or other suitable plastic in spherical donut form, as defined below, with a small battery and LED assembly inserted as herein described, with the manufacturing of the spherical donut taking place at greater than atmospheric pressure to produce an air-filled or partially air filled cavity but probably not one with any further inflation capacity in the consumers hands, i.e., some of these kinds of balls would be factory inflated only, although a tennis ball could be inflatable using a football type inflation pin. Lighted bowling balls are included in the spirit of this invention and would be made with the same structure as the other balls herein but of a suitable acrylic, polyethylene or other fairly rigid translucent plastic which might be acceptable to the semi-serious bowler, or at least to the bowling alley and the average bowler.

Thus, the preferred embodiment of this invention can be either inflatable or non-inflatable, which is an important advantage.

2/ Any self-lighted ball must be highly durable, strong and very shock resistant. The design of a single central cross-shaft provides better engineered support for the weight of the electronics than does a support from one side only. Turner in 1933 showed eight (8) supports which is stronger still but is perhaps too expensive to build at least as an inflatable ball. Also the supports screen-off too much light from reaching the ball's outer surface and then the viewing eye and they do so in an irregular manner. They would also interfere with bouncing freedom. A support on each side of the heavy electronics if properly strong and built-in to the ball actually works, absorbs a lot of shock and dampens vibrations quite well if the ball is properly inflated and the support is tight. The thickness of the ball's skin need only be 3/16" for extreme toughness and firmness, and a lot less for most balls.

3/ Critical to any successful illuminated ball is that the bulbs and batteries be readily accessible and easily replaced. They also should be widely available and very cheap. The present embodiment uses batteries that cost $0.99, more or less, and bulbs 1 that may be purchased for as little as $0.02–0.05 each. Other more costly and durable bulbs could also be used; however, experiments have shown little difference in life among a variety of much more expensive bulbs which still have fairly delicate filaments. This issue will be resolved further at the manufacturing level.

A major advantage of this invention is that the electronics, consisting of batteries, bulbs, switch, wiring, holders and sockets are all assembled in one piece, which may be easily removed for servicing which will often be necessary.

4/ A waterproof electrical compartment for the above electronics is desirable and rather essential for proper play around any water, whether in a pool, ocean, ditch, tub, rainstorm, or just in wet grass. The spherical toroid disclosed herein will have one end of its central tube permanently sealed with plastic at the rotational molding stage leaving only one end to deal with. There, ideally a suitably shaped tightly press-fitted by hand or threaded cap will be designed that keeps water out, yet opens readily. Thus the compartment will be kept relatively dry except for condensation when the bulbs are hot and the surrounding air is very cold. Said cap will be designed substantially flush with the ball's surface so that the ball will bounce and feel like a normal ball.

5/ All electrical components need to be absolutely as light as possible after sufficient durability is achieved. This is principally for three reasons: 1) Easier handling and the retention of the feel of a normal ball of whatever type or weight, 2) to reduce the violent tension forces on the ball's inner surface from the central tube caused by major acceleration and deceleration forces resulting from normal, spirited play and c) there is a safety element to consider. Heavy batteries swinging around inside a partially deflated ball can be felt through the side of the ball like a blackjack, and three or four ounces of weight thrown with high velocity can knock a little kid down, as of course a normal ball can do also. There is a place for about three to four ounces of batteries in some heavy balls but in lighter pliable balls for young children two ounces can be too heavy and less is often preferable.

6/ A good ball should be perfectly round, perfectly balanced and able to bounce or be thrown with complete precision. Even a football is totally predictable to an experienced user as its weight is uniformly distributed.

An illuminated ball with an eccentric weight distribution inside it behaves erratically and could be compared to a knuckleball in baseball or a wiffle ball in its flight pattern. Although this type of motion can serve a novelty function for a time and therefore is within the spirit of this disclosure, said erratic behavior is not the preferred embodiment, and is to be discouraged.

Rather, the heavy weights of batteries, holder, bulbs and conductors as compared to the usually lighter and perfectly symmetrical weight of the ball itself should be centered carefully for good "feel" and maximum maintenance of conventional handling characteristics. In other words, the center of gravity of the electronics should be very close to the exact center of the ball and should be firmly constrained in that position by the contracting central shaft when the ball is inflated. If this is done the ball handles quite normally in many playing conditions particularly if rotated during bouncing. If the weight of the electronics is not centered then the interested student of dynamics or statics can readily draw force diagrams to explain all kinds of unusual occurrences that take place during play; however, said centering of the weights and then spinning the ball some during play helps a lot, and really should be done.

7/ Although experiments with lightweight lighting systems showed that a self-illuminated ball can perform for a while with its battery and bulb attached to only one inner side of the ball, there are various disadvantages to that set-up which need not be considered here. It is fairly obvious that providing support from two opposite sides results in a stronger, better handling, and more reliable system, and experiments have generally confirmed this when proper construction and components are used. As discussed, surprisingly violent forces are perpetrated on the electrical connections and bulbs of an illuminated ball and they must be protected from vibrations and shocks, and should be as many inches away from direct kicks or baseball bats as possible Shake tests show that the internal crossing structure of the central tube greatly dampens vibrations, accelerations and other violent moments and movements. In all probability this central tube will be molded to the ball's spherical interior surface in one piece by using mold making techniques familiar to those in the business of manufacturing toroidal forms, such as wheelbarrow wheels.

8/ Experiments show that most soldered connections inside a luminous ball are a bad idea. Longer lasting are mechanical connections of the crimping type, etc. Heavy wire with plenty of slack or rigid conductors fabricated onto a plastic housing can be used and everything should be readily accessible for easy repair or replacement.

9/ Rapid inflation and deflation is helpful for any such ball and is mandatory here. Since the inner tube is designed to press in tightly on the central electronics to hold them gently, securely and precisely in position the inflatable luminous ball herein must be deflated in order to remove the electronic portion and to change bulbs or batteries. In some balls this will be done by metal pin type means through a rubber valve and in other balls, such as a thin vinyl beachball, simple inflation by mouth is possible and preferable. The on-off switch in this invention can be reached by opening the little waterproof cover while the ball remains fully inflated and operational.

10/ The invention described herein is designed to be as general, diverse and versatile as there are existing balls now. When production is begun, there should eventually be a multiplicity of sizes, thicknesses, weights, colors and simulated ball types. As mentioned, translucent white balls could easily be designed to look like a full moon and blue balls are reminiscent of the planet earth in space, etc. Playballs such as Newcomb-like or standard footballs, volleyballs, tetherballs, tennis balls, kickballs and softballs will be imitated in addition to other bright colored types and new types. Three or four sizes of electronics should be able to accommodate virtually all balls from tennis size to three feet in diameter; however, that is difficult to anticipate. An 8' diameter ball could use larger electronics.

11/ Although there are always exceptions, generally the battery weight should be in the range of ½ ounce to 3 ounces. 1½ ounce 9-volt batteries work well but lighter 6 volt batteries are better for handling and simulating the feel of a normal ball though shorter lived. Extremely bright diodes have been used in very translucent light or yellow balls with some success; however, at this point their cost seems unreasonably high in proportion to their brightness and resulting ball luminosity. Two heavy C-cell size batteries could be used in a heavy ball like a basketball; however, that is around the maximum weight for good handling in normal gameballs. A case could be made as Spector has done in U.S. Pat. No. 4,015,111, that extra weight improves the playing characteristics of some balls in the way that a basketball is more stable and throwable than a light vinyl beachball. With bowling balls and other conventionally heavy solid balls heavier batteries or lights might be an attribute and not a liability. However, overall it is of paramount importance to keep the weight of the lighting apparatus low. All designs will use cheap widely available sizes and voltages.

12/ A further advantage and objective of this invention is to provide illuminated balls made from any and all suitable translucent or transparent ball making materials of any thickness which include, but are not limited to, vinyl, flexible PVC, latex rubber, other rubber, polypropylene, polyethylene, cloth, wood veneer, resins and new materials yet to be invented.

13/ The bulbs are the weakest link in the concept and hence must be properly selected, socketed and protected within the ball. They should also be cheap and easily replaced.

The preferred embodiment provides novel transparent bulb protectors to prevent any part of the collapsed central tube from touching any part of a bulb thus eliminating one important cause of bulb breakage. The bulbs are also well located in the ball and are cushioned by three levels of shock absorbing systems as the ball is bounced.

14/ The preferred embodiment of this invention employs two very bright miniature bulbs strategically located such that the entire ball's surface is uniformly lighted and looks luminous in the darkness. Even one bulb doesn't look bad, and is in fact highly striking, and, of course, more than two bulbs can be used for more dramatic brightness, but shorter battery life and the hassle and expense of frequent battery changing.

There are many variables to consider in the selection and location of bulbs. The color, thickness and translucency of the ball's materials are important. Weaker powered bulbs in voltage×amperage or in brightness are acceptable in thinner light colored balls, but more powerful and bright bulbs generally look better but last a lot less time; thus, trade-offs are necessary for each type of ball. FIGS. 1 and 3 illustrate a good looking version whose two bulbs last over two hours on one small 9-volt alkaline battery wired in series.

The location of the bulbs shown in the drawings provide uniform lighting of the balls translucent surface without too much overlap, excessive shadows or bright spots, unlike most preceding illuminated balls, and are also in a very safe and protected position where they can be serviced.

Parallel wiring is used when possible as one bulb is a lot better than no bulbs when searching in the dark for the ball.

15/ Another advantage of the illuminated ball described herein is its convenient switch position just inside or flush with the waterproof cover. Said cover will protect it from water and a direct kick, yet it can be operated in seconds to save the batteries when playtime is over.

Said switch can be of any small, durable, economical and suitable type and would usually be located a sufficient distance from the batteries and bulbs to be situated about ⅛" to 1" inside the ball's surface after inflation for easy operation. Said switch might also be made of rubber or other suitable material with means protruding very slightly outside or flush with the ball's surface for activating said bulbs. The waterproof cover will normally be somewhat heavier than the rest of the balls skin for added durability. The switch should be either electrically or otherwise rigidly attached to the battery and bulb holders by a length of material somewhat larger than the radius of the ball, as shown in the drawings. Thus when the electrical system is inserted into said ball and the switch is precisely located flush with the ball's surface or at a mark ¼" inside on the shaft, the center of gravity of said electrical system is automatically located in the exact center of the ball for optimum handling and performance. Further details on this will be discussed below.

16/ Every serious inflated ball has its inflation means recessed. Several ways are commonly employed in the industry and the ball described herein can utilize any of them. For example, the common metal inflation pin type which is inserted into a flexible rubber hollow plug-like system may be imbedded in the ball during molding and then inflated and deflated by insertion of said metal pin which has threaded means for attachment to an air pump of some sort; or, various solid plastic pegs can be used which fit into a suitable diameter tight, tapered, molded hole in the ball's surface. Said plugs are sometimes attached to the ball by a flexible plastic hinge or they may be entirely separate from the ball. A third method for more frivolous types of balls, such as thin vinyl beachballs, utilizes an inch or so long, ¼" or so in diameter foldable, flexible tube which communicates with the ball's interior in such manner that blowing thru said tube by mouth inflates the ball. Thereafter said tube is tucked into a suitably designed slot in the ball's skin which effectively seals said tube and prevents air from escaping from the ball following inflation.

17/ The diameter of the central shaft has to be carefully designed. A priori reasoning would seem to indicate that the central shaft would be crushed down immediately and completely by pressures from the rest of the ball upon inflation. Experiments show, however, that in many instances, such as with fairly thick tubing materials, a wide tube, and relatively low inflation pressures that is not necessarily the case. The whole ball is expanding outwardly including parts of the central shaft at the same time that parts of the shaft are being nudged inwards due to tension on the shaft from its attachment points to the balls inner circumference and from compressed air pushing in from the pressurized portion of the ball. The net result is inward movement but not as much as one might expect without actual testing.

The conclusion to be drawn at this point is that a big sloppy shaft relative to the battery size, such as in U.S. Pat. No. 4,776,589, is not a good idea and may result in the inner electronics shaking around inside which will cause the ball to fail in a short time due to all kinds of problems. Rather, the shaft should be about the same diameter as the widest part of the width of the battery holder, which means approximately ½" to 1½ depending on the battery and ball size. When this design philosophy is followed, then the relatively modest contraction and tightening effect on the electronics by the central shaft will take place, holding said electronics rigidly in place with no slipping, and that is very important. Another reason for keeping the shaft size as narrow as possible is to keep the skin of the ball as tight as possible inside the shaft at the places where it is molded to the rest of the ball, as these skilled in the art could anticipate.

18/ Other advantages of any illuminated ball are that they can provide minor safety functions, such as acting as a signal, as an inefficient lifesaving device in water or to serve as a weak flashlight or worklight; however, these are strictly ancillary functions to its principle mission of providing exciting, beautiful and different recreation, some of which is undoubtedly not anticipated here.

19/ Finally, the illuminated ball which uses chemical as opposed to electrical lighting from within has one other very new and important advantage.

Experiments show that ordinary flamable chemical firework devices of the smaller type which produce lots of sparks, flame, smoke, light and some heat can be lit and put into a 4"–14" diameter self-supporting ball made of ⅛" thick or greater polyethylene or similar material with very unusual and exciting effects.

The ball can then be capped for total safety or left open to breath a little, and either way a luminous, flickering, and smoking ball results which may be thrown, kicked, caught and otherwise handled although a 15–20 second firework can warm a 3/16" polyethylene globe up above 100° F.

The primary design employed herein with a central shaft, possibly protected by Pyrex could be used, particularly with conventional fireworks such as sparklers; however, a commercial version of this idea would probably involve a removable tube which could otherwise be damaged by the flames, or could be based on a fireworks holder connected to the cover or cap. The concept also works nicely with an empty inner ball cavity, wherein the fireworks device is lit, dropped inside of the ball which then may or may not be capped. Then said fireworks device is free to roll around inside of the ball as it is handled. This method keeps any point on the ball's wall from reaching the melting point which is of some significance.

SUMMARY OF THE INVENTION

The present invention consists of an improved inflatable or not inflatable gameball with lights conveniently and properly located inside, such that the ball can be used for playing in limited light or complete darkness and looks luminous. This ball is molded in one piece for maximum air tightness and topologically is a spherical toroidal anchor ring or donut form with both open ends plugged off, or looked at another way, said ball is a sphere with a straight tube or other shaped shaft connecting one inner surface to another, usually diametrically across from it and all molded in one piece. Said shaft is the same material as the rest of the ball and houses the removable battery, switch and bulb holder combination which are referred to often as electronics herein. Upon inflation said tube contracts around the electronics holding them securely in place and said electronics may be further protected by a suitable flush mounted cap which seals water out of the central tube, but which tube is otherwise at atmospheric pressure and is not pressurized like the rest of the ball.

Another variation on this invention involves the use of chemi-luminescent substances such as Cyalume or common fireworks such as sparklers and other flame, spark and light producers. A modified central shaft may be employed for these versions or said shaft may be removed or omitted altogether for various fireworks versions, such as where ⅛"–¼" wall thickness polyethylene or similar balls are used. A novel, fun, commercial toy has been invented here. Key to the drawings and terminology to be used in the detailed description of the preferred embodiment.

FIG. 1

1. Translucent skin of ball, usually colored
2. Central shaft
3. Flush, waterproof cover or cap
4. Female rubber valve insert
5. Inflation pin, needle, or plug in other designs
6. Air supply, shown with threaded end
7. Conductor from battery to switch
8. Single battery, can be more batteries
9. Battery holder
10. Small bulb or LED
11. Bulb socket or mounting
12. Bulb protector from tube wall movement
13. Central shaft chamber at atmospheric pressure
14. End of shaft, tapered somewhat for mold removal, etc.
15. Solid, strong rotational molded junction
16. Electronics—comprising battery, lights, sockets, bulb protectors, mounts, switch and conductors
17. "On-off" switch for bulbs
18. Optional flap for lifting-up on cap 3
19. Air tight, pressurized inflated compartment
20. A place where shaft compresses down on electronics

FIG. 2

21. Wiring generally in parallel but occasionally in series
22. Bulge manufactured into shaft to hold electronics firmly in place
23. Additional padding, foam or spring to hold electronics if needed

FIG. 2

24. Spring to hold battery tightly in position
25. Conductor directly from batteries negative terminal
26. Direct negative conductor to other bulb
27. Example of a holder to prevent bulb from coming out of socket
28. Battery's negative terminal
29. Positive terminal of battery
30. Snap connectors to conduct electricity from battery to bulbs and switch

FIG. 1

31. Hinge for water proof cover
32. Marked point to use electronics assembly as gauge for locating its weight at center of gravity of ball
33. Shaft wall
34. Ball's skin at closed end of shaft

FIG. 2

35. Vertical walls of electronics assembly
36. Clear plastic holder about 1" wide×⅛" thick×-about 6"–12" long

FIG. 1

37. Extra ball material surrounding valve during molding

DETAILED DESCRIPTION OF THE PREFERRED EMBODIMENT

Figure 1:
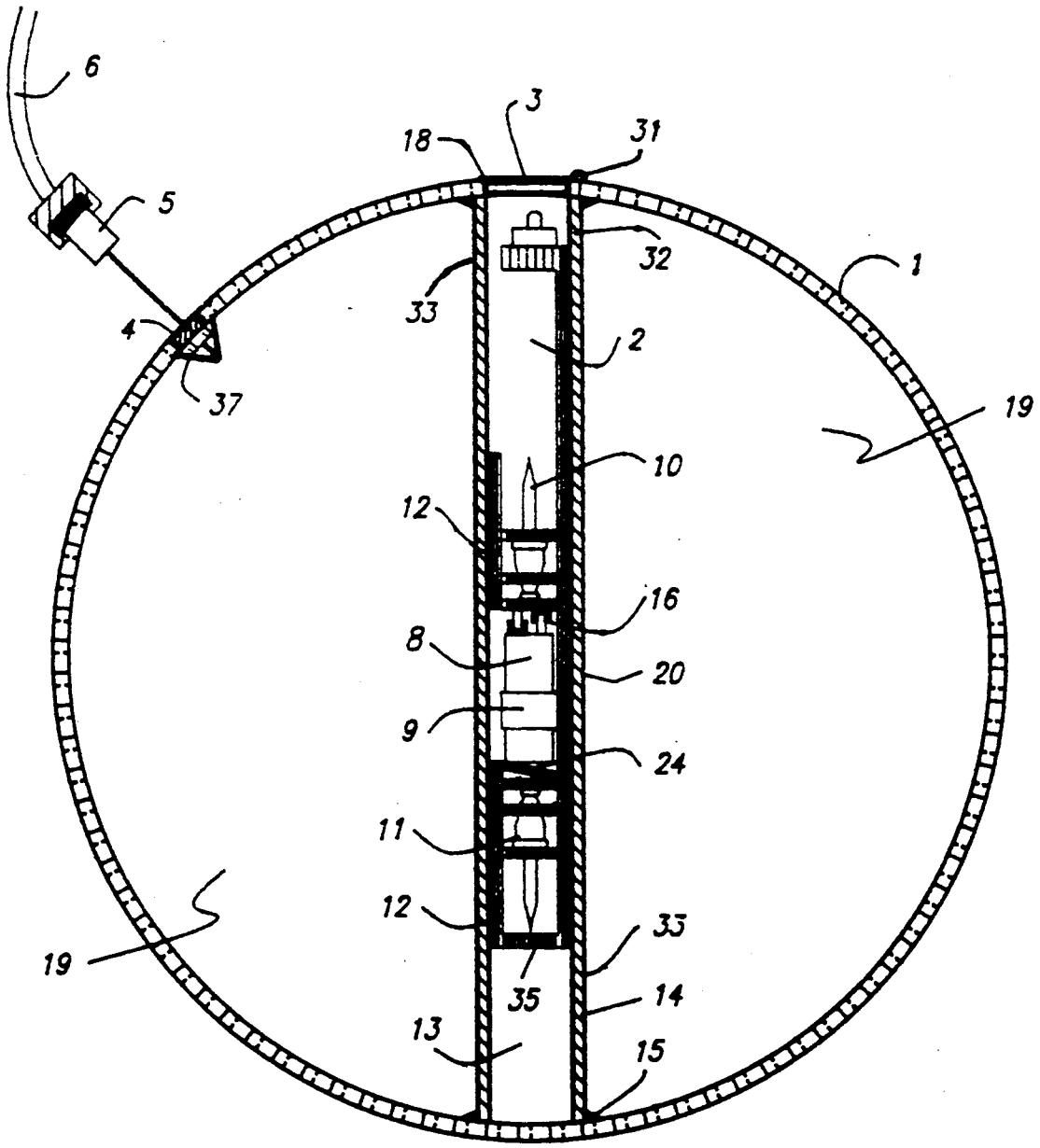
FIG. 1 Is a cross-sectional view depicting the structure of an inflatable version of this invention, shown partially inflated.

In order to further understand this invention, a cross-section has been taken through the center of a partially inflated illuminated ball, fully assembled, and drawn in FIG. 1.

In FIG. 1, the translucent plastic skin 1 of an illuminated ball of any size, or thickness, or color or artistic pattern is shown. For those that like to understand or see how things work, the ball could be transparent, and for a different effect fullmoon colored translucent white will undoubtedly be popular. The important central shaft which crosses the ball and is the same thickness, color and material of the rest of the ball houses the electronics 16, which comprise one or more batteries 8, battery holder 9, two bulb sockets 11, two bulbs 10, the bulb protectors 12, a rigid conductor 8 going to on-off switch 17, and various other supports and conductors.

These electronics 16 comprise one separately manufactured and assembled unit which can be removed easily from the ball's central shaft 2 for servicing of any of the unit's components. This shaft 2 which houses electronics 16 is not pressurized and functions at atmospheric pressure; however, it is kept waterproof by flush, waterproof cap 3 which can be opened by lifting up on flap 18. This cap 3 may or may not be hinged at 31.

Also in FIG. 1 is shown inflation means consisting of a standard rubber valve 4 which is inserted in the mold during manufacture so as to become imbedded in the side of the ball's skin 1 with some extra material 37 surrounding it to make it stronger. Said valve 4 is inflated by means of standard inflation needle or pin 5 which functions by threadably attaching it to a bicycle pump or other pressurized hosed air supply 6, inserting inflation pin 5 into valve 4 and then pumping in sufficient air to make the ball "hard". As shaft 2 is exposed to the atmosphere it contracts somewhat during said inflation procedure above.

Before inflation begins the electronics 16 are inserted into the shaft 2 in such manner and to such depth that the center of gravity of this system coincides closely with that of the ball. This is accomplished by designing all dimensions such that when the switch is held at a marked point 32 which is approximately the bottom of cap 3, then the fairly heavy electronics 16 will automatically be in proper position, at which time the ball can be inflated, which holds said electronics in proper position.

As mentioned above, inflation of the entire ball causes its translucent skin 1 to expand outward, but its inner skin or shaft wall 33, which is the wall of central shaft 2 compresses and collapses inwardly, thus holding electronics 16 in their proper position. This inner skin or tube wall 33 also provides several other important structural and vibration dampening functions and helps to preserve the life of the bulbs and the very ball itself during violent play with very large forces trying to rip shaft 2 away from skin 1. To counteract those forces, a strong solid rotational molded junction 15 is manufactured into this wall. Central shaft 2 is tapered somewhat on the lower end as shown at 14 and the inner chamber of this section of tube 2 is shown by 13 and it is this area as well as a similar area above the electronics that will be compressed in toward itself upon inflation and hence wall 33 and its opposite side will be closer together than shown in said inflated condition.

In other words, FIG. 1 is a relatively uninflated view of an inflatable ball. The reasons for the taper are to facilitate removal of the mold from the inside of central shaft 2 during manufacture and also to give the ball a better outward appearance at the outside end of shaft 2 shown at 34. The larger the diameter of shaft 2 at this point 34, the greater the propensity for wrinkles or a soft spot in the balls surface 1, with resulting reduction in handling and aesthetic qualities.

Figure 3:
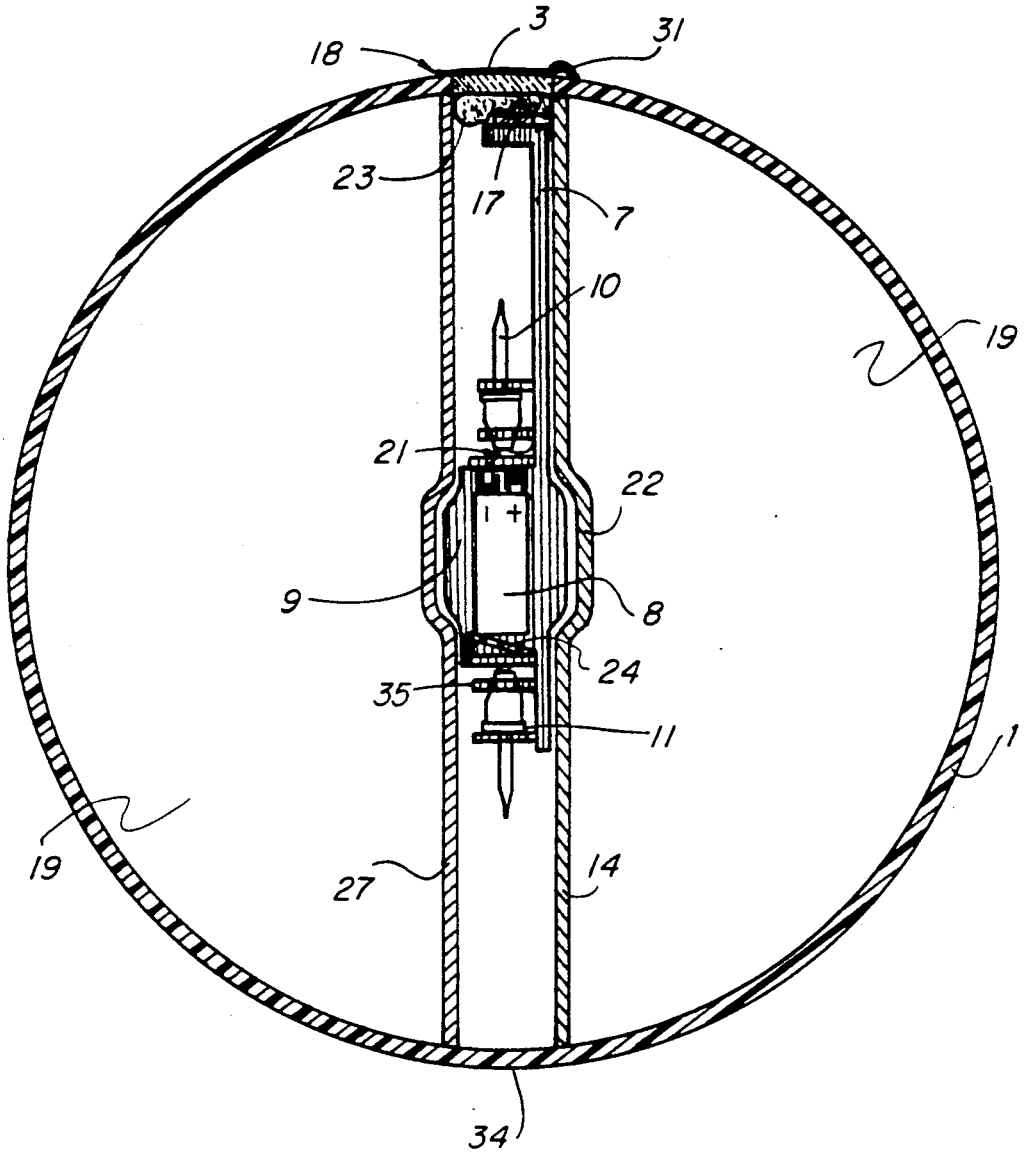
FIG. 3 Is a cross-sectional view of a non-inflatable version of this invention.

FIG. 3 depicts a different kind of ball which although possibly pressurized, is not inflatable and deflatable by the consumer. Tennis balls or bowling balls would be exemplifications of this type. Although the basic design of central shaft 2, skin 1, cover 3 and electronics 16 are virtually identical to the ball of FIG. 1, there are several differences as shown; however, in manufacturing, both balls could be structured identically if desired although that might not be optimal. The differences are that FIG. 3 shows a greater taper than that in FIG. 1. Said taper would also work in FIG. 1; however, for the ball of FIG. 3 said taper is essential because the electronics 16 must be crammed in tightly to shaft 2 so that they absolutely can't shift down any further. Another difference is that in FIG. 3, one type of ball might have a translucent means provided above the electronics 16 to prevent them from sliding upwards in the tube 2. Depending on the ball, various options exist such as translucent foam, crumpled-up vinyl or PVC, or a clear rigid plastic block of proper size wedged into the upper compartment of shaft 2 and shown as 23 on FIG. 3. The switch 17 and its rigid conductor 7 could also be wedged against the top of the ball in the area of 31.

However, the preferred method at this point would be to design the mold such that shaft 2 is formed in just the right bulging shape 22 such that when the electronics 16 are crammed downwards using conductor 7, switch 17 and housing 36 as a handle, electronics 16 wedge into a cavity which holds them tightly and prevents said electronics from going up or down or from side to side. The application then of approximately 15 or 20 pounds of force would be used to lift up on electronics 16 for removal and servicing. Thus a non-inflatable ball is feasible if not quite as elegant as an inflated ball.

Figure 2:
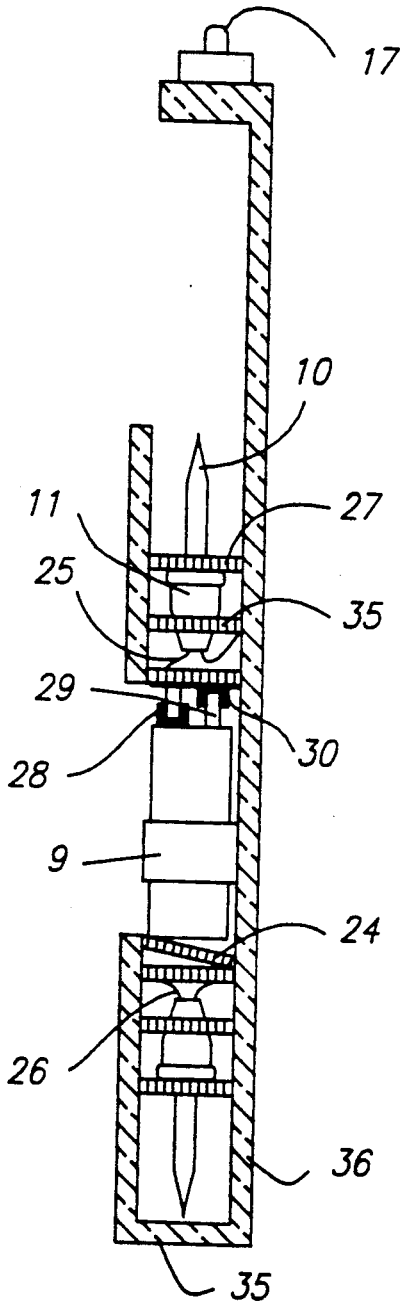
FIG. 2 Is a cross-section of the electrical components and holders which go inside either type of ball.

FIG. 2 is a side view of the electronics 16. The electrical components are mounted to a manufactured clear, fairly rigid, plastic holder 36 which is shown here approximately 1-½" wide, ⅛" thick, 1" high and 6" long. Suitable vertical walls 35 are constructed to attach bulb sockets 11 to and and they also hold a 9-volt battery 8 in this embodiment.

Ultra-economical miniature 3-volt Christmas light bulbs 10 are shown here which when run in series on 9-volts burn brightly, but if wired in parallel burn extremely brightly for brilliant effect, even when going through two translucent layers, and those tested were able to tolerate this excessive voltage. Enumerable other combinations of batteries and bulbs would also work as anyone skilled in the art could determine. Two AA or two C-cell batteries will drive two miniature Christmas bulbs in parallel, the later of which could be used in heavier balls.

In FIG. 2, two bulbs 10 engage two proper sockets 11 and are appropriately wired to negative terminal 28 directly. They then receive their positive flow 29 through on-off switch 17 which is rigidly attached to bent solid conductor 7 which is adhered to holder 36. To protect bulbs 10 from the arduous abrasion from central shaft 2 that could break the bulbs in seconds, a clear transparent bulb protector 12 is employed which keeps the shaft 2 from touching said bulbs 10. Also to keep bulbs 10 tightly in their sockets with proper electrical contact a bulb holder 27 of some sort is positioned as shown. To mount battery 8 in position a spring 24 pushes battery terminals 28 and 29 into conductor snap connections 30 from which electrical contact is made to said bulbs 10. One skilled in the art could design countless other ways to accomplish the same goal, namely of providing reliable, removable, bright light in the center of a translucent ball.

Cavity 19 could be pressurized with air at the factory or not, or filled with other translucent material for shock absorbing effect in a tennis ball, or perhaps filled with water to add weight to a bowling ball.

Infinite possibilities exist.

OPERATION OF A PREFERRED INFLATABLE EMBODIMENT

As designed, these balls are simple to operate, maintain and service, and should provide dramatic visual entertainment and pleasure.

The retail store would take the balls out of a box and the electronics 16 out of another box. Batteries 8 would be installed into holder 9, then the cap 3 is removed and the electronics are inserted until they are stopped by the taper 14 or the bottom of the bulged shaft 22, or until the switch is aligned with point 32. Next, proper air supply 6 is connected to needle 5 which is inserted into valve 4 and air is added until an appropriate degree of hardness is achieved. Finally, cap 3 is replaced and the balls are put out for sale, either illuminated or not.

To use, the cap 3 is lifted up by flap 18 and the On-Off switch is activated, then cap 3 is replaced and play commences, after which the switch 17 is turned to Off for indefinite storage of said balls. There are some advantages to having the switch 17 reach outside the ball through a hole in cap 3 which could be relatively waterproof and this is a viable alternative for lighter duty balls if a strong and perhaps waterproof switch can be obtained.

This illuminated ball, by actual experiments, is a new, truly exciting, awesomely beautiful, startlingly different, nighttime game for all ages with many versatile forms and possibilities difficult to anticipate.

While the drawings and above descriptions thereof contain many specific details, these should not be construed as requirements or limitations on the general scope of this invention, but merely as a few examples of thousands of ways to accomplish similar or varying results. Those skilled in the art will immediately envision many other possible types of luminous ball devices which are within the spirit and scope of this disclosure whose breadth must be determined from the appended claims and their legal equivalents and not by the drawings and the few other examples which have been given herein.

We claim:

1. An internally lighted playball comprising:

a. a translucent inflatable sphere made of a pliable material;

b. a pliable, diametrical, light-passing shaft integrally molded to said sphere and made of the same material as said sphere;

c. one removably covered opening to said shaft at said sphere's surface;

d. a fully removable, well-balanced, chemically energized illumination device with two or more light bulbs;

e. means for firmly securing said illumination device inside said pliable shaft such that its center of gravity coincides fairly closely with that of said sphere;

f. handle means for reseating and removing said illumination device;

g. separate on-off toggle switch means for activating said light bulbs;

h. self-sealing inflation valve.

* * * * *